United States Patent [19]

Fiedler

[11] 4,068,626

[45] Jan. 17, 1978

[54] FUEL CONTROL OF INTERNAL COMBUSTION ENGINES

[76] Inventor: Willy A. Fiedler, 12758 Leander Drive, Los Altos Hills, Calif. 94022

[21] Appl. No.: 638,086

[22] Filed: Dec. 5, 1975

[51] Int. Cl.[2] ..... F02M 37/04; F02M 69/00

[52] U.S. Cl. ..... 123/30 D; 123/32 L; 123/32 SP; 123/188 AF; 123/191 SP; 261/35

[58] Field of Search ..... 123/30 D, 139 BG, 139 AW, 123/188 AF, 30 C, 32 ST, 32 SP, 32 SA, 32 L, 191 S, 191 SP; 261/35

[56] References Cited

U.S. PATENT DOCUMENTS

| | | | |
|---|---|---|---|
| 1,815,097 | 7/1931 | Davidson | 261/35 |
| 2,435,659 | 2/1948 | Summers | 123/59 A |
| 2,759,718 | 8/1956 | Gideon | 261/35 X |
| 2,939,446 | 6/1960 | Dolza | 123/139 AW |
| 2,977,947 | 4/1961 | Carleton | 123/139 AW UX |
| 2,988,077 | 6/1961 | Hottenroth | 123/139 AW UX |
| 3,424,139 | 1/1969 | Brooks | 123/188 AF X |
| 3,782,339 | 1/1974 | Scholl et al. | 123/139 AW X |
| 3,826,234 | 7/1974 | Cinquegrani | 123/139 AW |
| 3,955,538 | 5/1976 | Noguchi et al. | 123/3 |
| 3,974,818 | 8/1976 | Noguchi | 123/32 SP |
| 3,982,504 | 9/1976 | Noguchi et al. | 123/32 L X |

*Primary Examiner*—Carlton R. Croyle
*Assistant Examiner*—Michael Koczo, Jr.

[57] ABSTRACT

Vanes in an air duct, independently controlled, one by the engine operator and others by environmental factors, generate vortices determining the speed of a turbine and thereby the flow of fuel through a fuel meter and fuel valves into prechambers for vaporization and mixing with spiraling air.

10 Claims, 2 Drawing Figures

FUEL CONTROL OF INTERNAL COMBUSTION ENGINES

BRIEF SUMMARY OF THE INVENTION

It is the object of this invention to further pursue the four goals of the continuing development of Otto cycle engines, performance, fuel economy, driveability and low emmissions, with improved fuel control and combustion, using simple hardware with few precision parts, compatible with currently produced engine types and producible in existing facilities without large investments for tooling.

To accurately meter the fuel flow it is proposed to generate air vortices in the engine air duct with several separate aerodynamic vanes, one reacting to power needs and others to environmental factors, and thereby control the speed of a propeller turbine and of a coupled fuel meter regulating the fuel flow from a vented float-bowl to vented fuel valves, from which the fuel is injected in cyclical increments into prechambers through which during each intake stroke air flows in spirals which are formed with ports tangential to the circular prechamber wall. Spiral flows rotating in opposing directions during each compression stroke cause turbulence for vaporization and mixing.

Figures 1, 2:
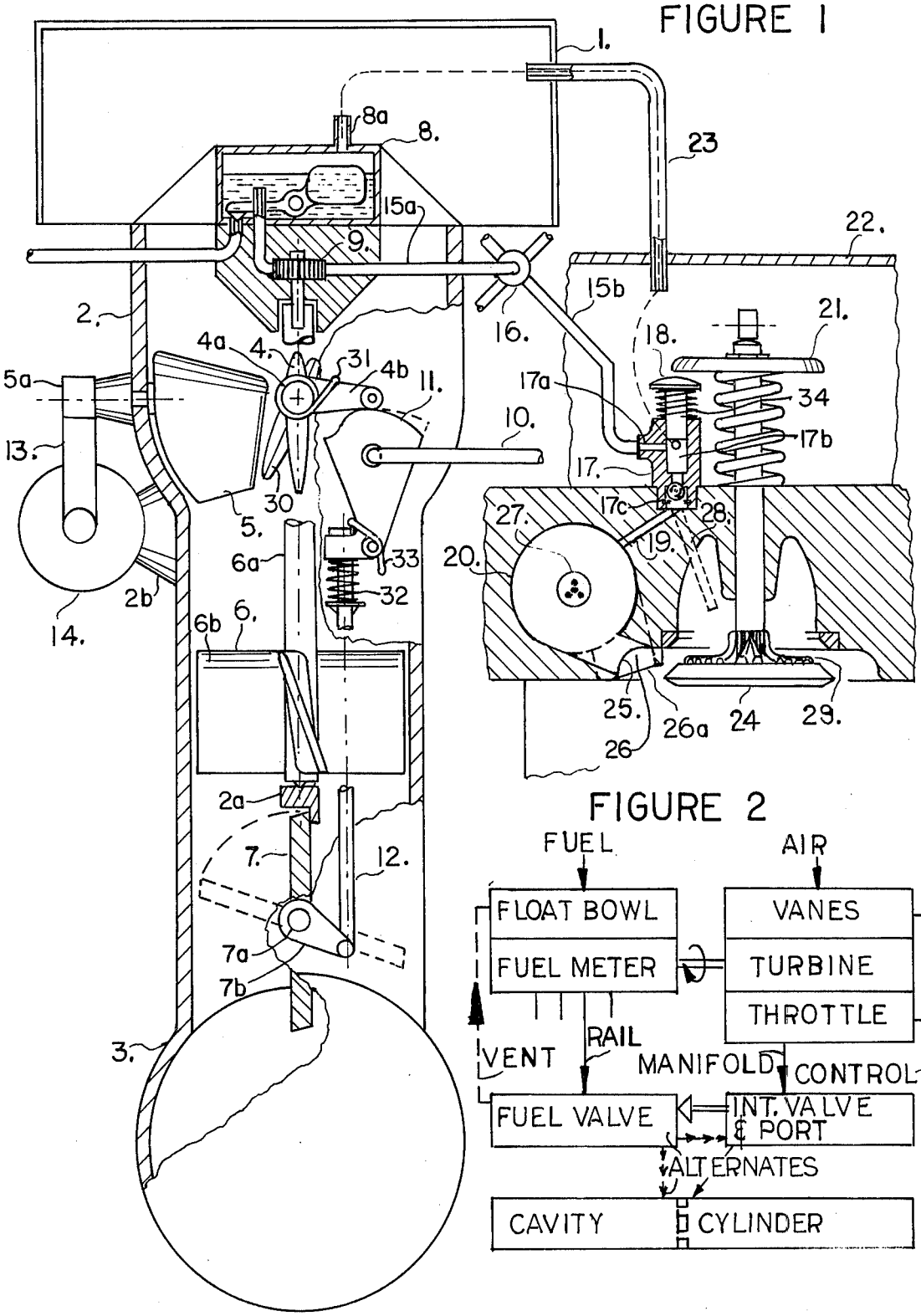
FIG. 1 is a semi-schematic view of a fuel control system in an internal combustion engine.
FIG. 2 is a functional diagram of a fuel control system showing the relation of its parts.

Application of the invention to reciprocating Otto cycle engines is shown in FIG. 1. Air enters through filter 1 and flows through duct 2 into manifold 3 after passing by aerodynamic vanes 4, 5 and 30, propeller turbine 6 and throttle 7. The turbine is forced to respond to changes of air mass flow and operational needs with air vortices generated in the duct by said vanes. Fuel flows from float bowl 8 to fuel meter 9 which is mechanically coupled to said turbine. Engine power is controlled with rod 10, linked to vane 4 with lever **4*b*, spring 31 and cam 11 and to said throttle with rod 12. The cam is shaped to cause enrichment of the mixture during idle and at higher power levels. Vane 5 is positioned with bimetallic spring 13 and barometer gauge 14, both exposed to ambient air. Vane 30, located behind vane 4**, is positioned with a bimetallic spring exposed to engine heat or actuated manually during engine warm-up.

Fuel manifold or rail 15 connects said fuel meter with flow divider 16 and with a fuel valve 17 at each cylinder. Incoming fuel is accumulated in the vented valve body during compression, expansion and exhaust strokes. Plunger 18 closes fuel inlet **17*a* and venting orifice 17*b* and then expulses the fuel increment and air enclosed in the valve body through check valve 17*c* and drilling or tube 19 to prechamber 20. A part of the intake valve train, such as spring retainer 21 actuates the fuel valve and times increment delivery. The space under valve cover 22 is at all times vented to air filter 1 and float bowl 8. As air flows radially from the open intake valve 24 some enters through port 25 into said prechamber, spirals through it and out through port 26 which is displaced from port 25 and shielded from the intake air flow with lip 26*a*. Mixed with vaporizing fuel and very turbulent after compression the charge in the prechamber is ignited with spark plug 27. Said ports direct precombustion flames and products into the main charge. Shown also in FIG. 1 is an alternate way of fuel delivery with the increments squirted through tube 28 to one side of said intake valve and channeled in part through port 25** into the prechamber.

DETAILED DESCRIPTION

A metering unit, combining float bowl, fuel meter, vanes with sensing actuators, turbine, throttle and air duct, can be designed for any air flow direction and is compatible with convential air filters, manifolds, fuel filters and tank pumps.

A multi-bladed propeller is the preferred embodiment of the turbine. Its speed increases linearly with the volume flow rate of air. Low moment of inertia and friction assure fast response to air velocity changes and limit speed errors. Propeller speed range and blade area and incidence angle must be compatible with the selected type of fuel meter, preferably a small gear type meter coaxially connected to the turbine. With the fuel flowing under gravity from a float bowl to fuel meter and fuel valves the head pressure compensates for some friction losses. The turbine spin rate is governed with movable vanes, placed ahead of the propeller, by generating vortices which force the turbine to respond to changes in air mass flow rate instead of volume rate and also to variations in environmental and operational conditions requiring different air/fuel ratios. The spin rate depends on air speed, on the incidence angle of the turbine blades and on the helix angle of a vortex. Any small number of vanes can be employed and combined with sensing actuators in different ways. A three vane system is the preferred embodiment. A third vane, part 30 in FIG. 1, substantially of the same form and construction as vanes 4 and 5 and located opposite of vane 4 behind shaft **6*a* of turbine 6 is deflected to increase turbine speed during cold starts with a bimetal spring exposed to engine temperature or with a manual choke. Vane 5 is rotated to decrease turbine speed at lower air densities with bimetallic spring 13 reacting to changes of air temperature, attached to shaft 5*a* and to a barometric gauge 14, preferably of the aneroid type, attached to lug 2*b* of duct 2, both exposed to air flowing into or through the duct; the latter position is suitable for supercharged engines. Vane 4 is rotated to cause an increase of the turbine speed when lower air/fuel ratios are needed at higher power levels and during idle. This vane is linked with lever 7*b* and shaft 7*a* to throttle plate 7 which serves to control power at the lower levels. After reaching a stop on crossarm 2*a* only vane 4** continues to rotate to increase fuel flow. It can be deflected also to slow or stop the turbine during vehicle deceleration and downhill travel. The vanes can preferably be placed in a spherical zone of the duct to minimize gap losses and increase air vorticity thereby reducing needed vane area. Aerodynamic balancing of a vane minimizes actuation forces and thus actuator size, which is achieved by locating the rotation axis at $\frac{1}{4}$ chord of the vane.

The air manifold requires no heating equipment. The fuel manifold consists of main line **15*a*, flow divider 16 and individual lines or hoses 15*b* to each cylinder. Their flow resistances can be kept very small and can furthermore be matched with those of the air manifold branches. Fuel flowing through the manifold must, in contrast to known fuel injection methods, not overcome differential pressures because the air pressures in the float bowl and the fuel valves are equalized through vent lines connecting orifices 17***b* in the fuel valves with vent 8*a* of the floatbowl which is also open to ambient air, or, the preferred embodiment, by venting each orifice directly into the valve chamber under cover 22 which is connected through vent tube 23 and air filter 1 with vent 8*a*. Without venting, large pressure differentials across the fuelmeter could cause unacceptable errors in the fuel flow rate from leakage and also from power extraction from the turbine affecting its speed.

Fuel valves 17, able to receive the varying flow in a vented space and deliver it in increments to the cylinders, in a liquid stream through a checkvalve to one side of the intake valve head or, the preferred method, directly into a prechamber.

This cavity, preferably cast into the head, contains a small part of the compression volume. Circular in cross-section it has two or more ports which are tangential to the circular prechamber wall laterally and angularly offset from each other to direct the flow to spiral through the prechamber. One port, located adjacent to the intake valve 24, receives a small part of the air flowing radially from the intake valve, which then flows in a spiral through the cavity and downwards out through one or more ports. The spiral flow pattern depends on the cavity shape, on the geometric relation and size of the ports and their placement relative to the intake valve. Air mixes with exhaust residuals and with fuel flowing into the prechamber directly or through its inlet port, The fuel vaporizes in the hot cavity and a relatively rich mixture remains in it at the end of the intake stroke. During compression turbulence is generated by internally opposing flows entering through both ports, which serves to complete mixing and vaporization. Precombustion flames and products emitting out of all ports are directed into and mainly to the middle of the turbulent and lean main charge. The jet pattern depends on the geometric orientation of the prechamber to the cylinder and the relation and relative size of the ports.

Ways to produce parts for the disclosed fuel control system are apparent to persons skilled in the pertaining art. Many parts of known fuel control systems including those for the limitation of emissions are eliminated and fewer precision parts are needed which reduces costs and simplifies servicing.

I claim:

1. An arrangement for supplying fuel and air in dependence of operational and environmental conditions to an internal combustion engine, comprising in combination an air duct for delivering air to said engine;

air control means, including a throttle plate for controlling air flow in said air duct, means for controlling said throttle plate, a plurality of vanes movably mounted in said air duct for generating air vortices, means for controlling each of said vanes independently, means for measuring air speed and vorticity in said air duct;

fuel flow control means, including a floatbowl containing fuel under near-ambient pressure, means for metering fuel flow, at least one fuel valve receiving said metered fuel flow, venting means between said fuel valve and said floatbowl for holding pressures within said fuel flow control means at near-ambient, a manifold interconnecting said means for metering fuel flow and said fuel valve;

means for coupling said means for measuring air speed and vorticity with said means for metering fuel flow;

whereby said fuel flow control means are governed by said air control means, wherein said means for measuring air speed and vorticity are controlled by said throttle plate and said vanes in said dependence of operational and environmental conditions.

2. In the arrangement of claim 1 said air duct including a first cylindrical section, a second cylindrical section having a diameter smaller than said first cylindrical section for providing amplified vorticies, a spherical section interconnecting said cylindrical sections and housing said plurality of vanes, said plurality of vanes having their axes of rotation intersecting at the geometrical center of said spherical section, each of said vanes having an edge conforming with said spherical section for minimizing aerodynamic gap losses.

3. An arrangement as set forth in claim 1 further comprising means for measuring density of said air, means for measuring engine temperature, and wherein said plurality of vanes include a first vane for generating vortices under control of said means for controlling said throttle plate, a second vane for generating vortices under control of said means for measuring density of said air, a third vane for generating vortices under control of said means for measuring engine temperature.

4. An arrangement as set forth in claim 1 wherein said means for controlling said throttle plate and said first vane are interconnected with a cam for interrelating the movement of said first vane with the movement of said throttle plate, a lever on said first vane, an arm on said throttle plate, a rod connecting said cam with said arm, a spring for interrelating the movement of said cam and the movement of said throttle plate, whereby during the first section of movement of said cam said throttle plate moves in predetermined relation to the movement of said first vane, and whereby during the second section of movement of said cam only said first vane moves and said throttle plate remains still in the open position.

5. The arrangement of claim 1 wherein said means for measuring air density comprises a bimetallic spring attached to said second vane, a barometric gauge interconnecting said bimetallic spring and said duct, whereby both are deflecting in predetermined dependency of said air density.

6. The arrangement of claim 1 wherein said means for measuring engine temperature controlling said third vane comprise a bimetallic spring interconnecting said third vane and said duct and deflecting in predetermined dependency of the temperature of the adjacent engine.

7. An arrangement as set forth in claim 1 wherein said means for measuring air speed and vorticity comprise a turbine with a plurality of blades a shaft for coupling said turbine to said means for metering fuel, said turbine rotating under control of air speed and of the sum of said vortices generated by said vanes and responding to movements of anyone of said vanes.

8. The arrangement of claim 1 wherein each of said vanes is rotatable around a shaft and aerodynamically balanced around the center line of said shaft thereby minimizing actuation forces.

9. An arrangement for supplying fuel and air in dependence of operational and environmental conditions to an internal combustion engine, having at least one combination of a cylinder, a piston cyclically performing intake, compression, expansion and exhaust strokes, an air intake valve providing air to said cylinder, a fuel valve receiving and holding fuel and vent air under near-ambient pressure, and a valve train operating said intake valve and said fuel valve, comprising fuel flow control means, including a floatbowl containing fuel under near-ambient pressure, means for metering fuel flow, at least one fuel valve receiving said metered fuel flow, venting means connecting said fuel valve and said floatbowl, a manifold interconnecting said means for metering fuel flow and said fuel valve;

at least one fuel apportioning means, including a plunger in said fuel valve, plunger actuation means on said valve train, a checkvalve for controlling the flow direction of said fuel and said vent air, said plunger cutting said fuel flow from said fuel control means into increments and expulsing said increments together with said vent air from said fuel valve;

at least one mixture control means, including a prechamber with circular crossection for vaporizing said fuel increments, a tube interconnecting said checkvalve and said prechamber for delivering said fuel increments from said fuel valve to said prechamber, means for generating spiral flows in said prechamber for vaporizing and mixing said fuel increments with said air, including a first port and a second port, displaced laterally and angularly from each other, with axes tangential to the circumference of said prechamber, said first port facing the air flow from said intake valve and said second port oriented to prevent said air flow from entering said prechamber through said second port; said first port directing said air flow into a first spiral flow in said prechamber during said intake strokes, said first and second ports generating a second spiral flow and a third spiral flow opposing said second spiral flow in said prechamber during said compression strokes.

10. In an arrangement as set forth in claim 1, said engine having a valve chamber, venting means interconnecting said fuel valve and said floatbowl including a venting tube linking said valve chamber with said air duct for equalizing pressures at near-ambient levels.

* * * * *